US008395559B1

(12) United States Patent
Josypenko

(10) Patent No.: US 8,395,559 B1
(45) Date of Patent: Mar. 12, 2013

(54) CAPACITIVE LOADED GRID ANTENNA

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 376 days.

(21) Appl. No.: 12/880,346

(22) Filed: Sep. 13, 2010

(51) Int. Cl.
*H01Q 13/00* (2006.01)
*H01Q 9/16* (2006.01)

(52) U.S. Cl. ..... 343/773; 343/793; 343/909; 343/756; 343/872

(58) Field of Classification Search ..... 343/773, 343/793, 909, 872, 756
See application file for complete search history.

(56) References Cited

U.S. PATENT DOCUMENTS

| | | | | |
|---|---|---|---|---|
| 6,972,726 | B2 * | 12/2005 | Sato et al. | 343/725 |
| 7,525,501 | B2 * | 4/2009 | Black et al. | 343/773 |
| 2005/0253763 | A1 * | 11/2005 | Werner et al. | 343/745 |
| 2007/0252775 | A1 * | 11/2007 | Munk et al. | 343/872 |

* cited by examiner

*Primary Examiner* — Dieu H Duong
(74) *Attorney, Agent, or Firm* — James M. Kasischke; Jean-Paul A. Nasser; Michael P. Stanley

(57) ABSTRACT

A forty five degree polarized antenna having grid layers wrapped around a vertically polarized dipole, or grids wrapped internally or externally around a vertically polarized bicone antenna, and having grid segments separated by capacitors that can attenuate, remove or minimize circumferential resonances that appear due to the presence of the grids and reduce the nulling effects from reflections from the innermost grid layer.

19 Claims, 12 Drawing Sheets

CAPACITIVE LOADED GRID ANTENNA

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

This application is related to a patent application filed on the same day by the same inventor entitled ZERO DEGREE GRID ANTENNA.

BACKGROUND OF THE INVENTION (1) Field of the Invention

The present invention generally relates to vertically polarized RF antennas and more specifically to bicone and dipole antennas.

(2) Description of the Prior Art

In the signal detection environment, it is often desirable to detect both horizontal and vertical polarized signals on the horizon over a broad bandwidth. It is also desirable that the response to both polarizations is equal. Optionally, an antenna may be used in a vertical stack of antennas, which requires cables to pass vertically by the antenna to other antennas above the antenna.

A typical solution to detecting both horizontal and vertical polarized signals over a broad bandwidth whereby the response to both polarizations is equal, is to use a vertically polarized bicone antenna positioned cylindrically in many cylindrical layers of polarizing grids that slowly rotate the incident field from cross 45 degrees to close to cross 0 degrees (90 degrees to the horizon, vertically polarized), as shown in FIGS. 1A and 1B. Grids pass signals that are cross, or perpendicular to, the grid angle or pitch angle of the grids.

The components of to-be-received horizontal and vertical polarized signals of equal amplitude are of equal amplitude at cross 45 degrees. Thus for equal response to either polarization, the grid and bicone configuration receives this component of either of the polarizations. A bare minimum of three layers of grids of grid angles 45, 30 and 15 degrees rotates the cross 45 degree component from respectively cross 45 to cross 30, and to cross 15.

The bicone inside of the 15 degree grid layer finally receives the signal at cross 0 degrees (vertical polarization, 90 degrees to the horizon). One layer of 45 degree grids is a possible configuration that passes a to-be-received signal component of cross 45 degrees to the cross 0 degrees vertical polarization of the bicone, although there is a 3 decibel polarization mismatch loss.

In general, the amount of rotation of polarization to be done by the grids determines the bare minimum number of grid layers that is needed to minimize to a reasonably small value the polarization mismatch loss of the grids. A reasonable rule dictates that at least one grid layer is needed per 15 degrees of rotation. Thus 45 degrees of rotation requires three grid layers with grid angles of 45, 30 and 15 degrees.

The grid layers are arranged radially so that the layers of larger grid angles have corresponding larger radii. In other words, a grid layer's pitch angle will increase directly with an increase in radius.

In all configurations, with the length of the grid lines long enough to cause reflections, the distance between adjacent grid layers must be less than ½ wavelength (½λ) and the distance between the innermost grid layer and the axis of the bicone must be less than 1 wavelength. At ½ or 1 wavelength separations, cancellation of the incident and reflected signals occurs respectively between adjacent grid layers or the innermost grid layer and the axis of the bicone, causing a problematic signal gain null and degraded patterns. For the innermost grid layer and the axis of the bicone case, this null also occurs at higher integer multiples of a half wavelength, e.g. 1.5, 2.5 . . . wavelengths, although of decreasing intensity as the integer multiples of a half wavelength increases.

NEC (Numeric Electromagnetic Code) government models using a narrow dipole antenna instead of a bicone antenna in the configuration have shown that cancellation between the innermost grid layer and a dipole starts at 0.5, not 1.0, wavelength separation. It is not known if the difference between the two cases is dependent upon the use of a bicone or a dipole.

Resultant problems and additional problems of using grids external to the bicone are noted below.

The distance between the innermost grid and a bicone axis can quickly approach 1 wavelength at which cancellation occurs, especially if the bicone is being used at frequencies where it is electrically large, i.e. larger than 1 wavelength.

Additionally, the grids are parasites of finite size and thus can have resonances, e.g. circumferential resonances in this configuration.

Circumferential resonances occur when the circumference of the grid layer is an integer multiple of a wavelength. Such resonances usually severely degrade the required azimuthal omni patterns of the bicone at the frequencies of the resonances, due to re-radiation or reflection off of the grids. The resonances appear as negative spikes or nulls when illustrated in gain versus frequency plots.

Resonances can be expected to be made less severe by making the grids more broadband by making them larger. For example, the heights of the grids can be increased. However, measurements have indicated that increasing grid height has little effect on decreasing pattern degradation at resonance frequencies.

Additionally, the circumference of grid layers can be made larger so that higher order resonances appear in the frequency band of interest. The worse case resonance is when the circumference is 1 wavelength. Usually resonances when the circumference is 3 or more wavelengths can be ignored since pattern degradation is small.

Typical measurements, such as for a configuration of a bicone inside 15 and 30 degree layers of grids, have shown the following severity of gain nulls (see TABLE 1).

TABLE 1

| Resonance Circumference of Outermost Grid Layer (wavelengths) | Gain Null Depth (decibels) |
|---|---|
| 1 | −35 |
| 2 | −7 |

Vertical and horizontal polarization gain (decibel) versus frequency (wavelength) plots for all azimuths are shown in respective FIGS. 2 and 3. First and second nulls are noted for each grid layer, $N1_{15}$, $N1_{30}$, $N2_{15}$ and $N2_{30}$, respectively. The frequencies in FIG. 2 and FIG. 3 corresponding to the respective 1 and 2 wavelength circumferences of the 15 degree grid layer are noted at $1\lambda_{15°}$ and $2\lambda_{15°}$ whereas the frequencies corresponding to the respective 1 and 2 wavelength circumferences of the 30 degree grid layer are noted at $1\lambda_{30°}$ and $2\lambda_{30°}$. Notice that nulls are located at or close to the circumferential wavelength points.

Note that a small space separates the 15 degree and 30 degree grids with the 30 degree grids being a little larger in radius and circumference. This results in the resonances of both grids not being exactly at the same frequency. The 30 degree grid resonances are a little lower in frequency than those of the 15 degree grids. The 1λ and 2λ resonance frequencies for both grids are shown on FIGS. 1 and 2. The double resonances are seen with the first null being actually composed of two closely spaced nulls $N1_{15}$ and $N1_{30}$, and the second null composed of two closely spaced nulls $N2_{15}$ and $N2_{30}$.

The nulls are at or close to the circumferential wavelength points. Gains for horizontal polarization and below the first null are spread out since the antenna configuration was below its cut-in frequency resulting in the feed cable of the bicone starting to become part of the antenna and radiating asymmetrically in the azimuth plane. Measurement problems also spread out the gains above the second null.

Optionally, cables are allowed to vertically pass the antenna configuration. To allow one or more cables to pass vertically by the antenna, the cables are run parallel to the outermost layer of grids and outside of, and insulated from, the grids as shown in FIG. 1A.

Running the cables parallel to the outermost layer of grids minimizes shunting of the antenna by the cables and upsetting the azimuth patterns, since the cables are at the polarization shunted by the grids. To minimize further shunting by the cables in the area past the grids, the cables should be kept away from the top and bottom of the bicone, and thus should maintain at least the same radial distance from the bicone axis as in the area where the cables pass the outermost grid layer.

Describing the components of the antenna configuration in FIG. 1A in more detail, a bicone antenna 30 is made up of two cones, a top cone 18 and a bottom cone 20 arranged as shown. A coaxial cable 22 feeds the bicone at the feed point 26 of the antenna where the outer conductor 21 of the cable 22 is connected to the bottom cone 20 and the center conductor 23 of the cable 22 is connected to the top cone 18. The feed angle $\theta_F$ is the angle between the two cones at a feed point 26, and is usually picked so that the characteristic impedance $Z_0$ of the bicone is that of the coaxial cable (50 ohms) to ensure optimal match.

The bicone is wrapped in three layers 12, 14, 16 of grids of grid angles of 15, 30 and 45 degrees (see also FIGS. 1B, 1C, 1D), respectively, where the separation between adjacent grids or the innermost grid and the extreme edge of the bicone is a constant value. The grid layers are arranged radially so the layers of larger grid angles are of larger radius from the antenna axis 10.

The grid layers are kept separated by placing foam spacers between adjacent layers or between the innermost layer and the bicone, or by placing the whole configuration in a cylindrical dielectric box (not shown) whose top and bottom are mounted to the top and bottom of the bicone and whose top and bottom have slits on their insides in which the top and bottom edges of the grid layers are placed and held in place.

The height 24 of the grid layers are at least that of the height 24 of the bicone (FIG. 1A). Any cables 28 running vertically past the antenna 30 are run parallel to the grids of the outermost layer of grids and outside of, and insulated from the grids. In the same area past the grids, the cables preferably maintain at least the same radial distance from the bicone axis 10 as in the area where the cables pass the outermost grid layer. If there is more than one cable, the cables are placed symmetrically about the circumference of the outermost grid layer.

FIGS. 1B, 1C and 1D details the layers 12, 14, 16 of FIG. 1A with each layer unwrapped. A layer is made by etching or cutting metal 41 off of a plastic sheet 43. A typical way to un-join the layer from its cylindrical position about the bicone is to cut the layer along a line 40 parallel to and halfway between two of the grids making up the layer. It can be rejoined later with tape.

A grid 45 is a metal line that extends from the bottom to the top of the sheet having a height 24. The angle the grid makes with the horizontal is the grid angle $\theta_G$. In FIGS. 1B, 1C, 1D the grid angle $\theta_G$ is 45, 30 and 15 degrees, respectively. The width 32 of the grid compared to the width 34 of the non-gridded area of the sheet is somewhat arbitrary. The width 32 is non-critical as long as the extremes of the line width are not used. In FIG. 1B the metal width divided by the total width 36 available for a grid is 0.5.

The length of a grid line should be at least ½ wavelength, so it can reflect away the field parallel to the grids.

The number of grids on a sheet is determined by the required spacing between the grids. This spacing should be appreciably less than 1 wavelength for appreciable attenuation of the field parallel to the grids, as further discussed in the case of a bicone in internal grids below. Note that the actual number of grid lines is much larger than shown in FIGS. 1B to 1D.

Another possibility to reduce the effects of possible resonances and to reduce pattern degradation when the separation between the bicone and grids is one wavelength is to place the grids within the bicone as shown in FIG. 4.

The internal grid bicone antenna 51 of FIG. 4 includes a bicone having a height 59, two circumferential edges 57, and a radius 15 measured from the bicone or antenna axis 10. The antenna includes a top cone 18, a bottom cone 20, a feed angle $\theta_G$, a feed point 26, 15 degree grid layer 50, 30 degree grid layer 52 and 45 degree grid layer 54.

An internal grid bicone antenna reduces resonance effects since the grids are more highly coupled to the bicone and are thus less a parasite. If the layers are small enough in circumference, operation below the first resonance, where the circumference is one wavelength, is possible. Also the null frequency, where the separation between the bicone axis and innermost grid is one wavelength, is pushed to higher frequencies since the separation is reduced. Thus the antenna configuration can be used at higher frequencies. However, several problems arise from this configuration.

Placing the grids within the bicone starts to defeat the purpose of the grids, which is to rotate the field for an antenna behind the grids. In the internal grid configuration, part of the bicone is behind the grids in the rotated field, and part of the bicone is ahead of the grids in the field that has not yet been rotated.

The part of the bicone ahead of the grids is the two horizontal edges 57 of the bicone, which act as a pair of horizontal grids. Long grids start to allow the field they are supposed to block, i.e., the field parallel to the grids, to pass at roughly when the spacing between the parallel grids is 1 wavelength. Thus, below 1 wavelength the two horizontal edges 57 of the bicone can block horizontal polarization from being received by the grids and bicone. Thus the height 59 of a wide internal grid bicone must be at least 1 wavelength for horizontal response to equal vertical response.

For an idea of the approximate amount of blockage that a layer of grids can achieve to polarization parallel to the grids, below is a representative TABLE 2 of the amount of field blockage of grids versus grid separation obtained from NEC from a dipole probe in front of a 2 wavelength by 2 wavelength sheet of grids.

TABLE 2

| Number of Grids | Grid Separation (wavelengths) | Rejection (db) |
|---|---|---|
| 3 | 1 | 0.5 (interpolated) |
| 5 | 1/2 | 2 |
| 6 | 3/8 | 2.5 |
| 9 | 1/4 | 4.5 |
| 17 | 1/8 | 9.5 |
| 33 | 1/16 | 16 |

The cases with a small number of grids in Table 2 above may be suspect since only a 2 wavelength by 2 wavelength sheet of grids was used.

Placing the grids within the bicone increases the cut-in frequency of the bicone more than what occurs with bicones with external grids. The cut-in frequency is defined as the frequency where the VSWR (Voltage Standing Wave Ratio) about the characteristic impedance $Z_o$ of the antenna becomes a low, flat level. This is because the grids are shunting the bicone at a point closer to the bicone feed point 26.

Vertical passage of cables past a bicone in either external or internal grids is done by having the cable follow the path of the grids of the outermost grid layer outside of the outermost grid layer. Since grids shunt any field along their direction, the antenna impedance-wise will usually not see the cable at the frequencies where it is of low impedance, being those frequencies above cut-in. Below cut-in, the bicone and similarly sized grids have high impedance and thus coupling to lower impedance longer cables going past the bicone is possible resulting in the cables becoming part of the antenna and radiating usually undesirable patterns. Obviously, this is an undesirable property if operation below cut-in is important.

SUMMARY OF THE INVENTION

Accordingly, it is an object of the present invention to attenuate, remove or minimize circumferential resonances due to grids wrapped around a vertically polarized dipole antenna, or grids wrapped internally or externally around a bicone antenna.

Other objects and advantages of the present invention will be apparent in view of the following description, drawings and claims.

DETAILED DESCRIPTION OF THE INVENTION

The following explanation and compromised solution is presented to overcome the problem of bad patterns and gain nulls occurring at the circumferential resonances of the grids of an antenna, where the circumference of the grids is an integer multiple number of wavelengths in size.

Let the low frequency response be only vertical, thus at low frequencies the grids are made to disappear electrically (i.e., coupling between the grids in a sheet forming a resonant medium and the electrical reflective property of the grids are eliminated) at the frequencies of the resonances. Since the severity of the pattern degradation and gain null decreases with higher integer multiples of wavelength circumferences, performance may be acceptable if the grids disappeared at the first two resonances, or even at just the first resonance. With no polarizing grid effects present, the polarization response of the antenna configuration is the response of only the antenna inside of the grids, which is usually a vertically polarized dipole or bicone.

Such a configuration described above would have problems with cables passing vertically past the antenna configuration, since the cables can no longer hide behind normal grids which shunt the field along their length. Without a shunted path to hide in, the cables themselves will shunt the antenna to various degrees causing problems such as the cables becoming part of the antenna and resulting in asymmetrical azimuth patterns.

Let the high frequency response be both horizontal and vertical. At higher frequencies, where the less severe effects of the higher order circumferential resonances are tolerable, the effect of the polarizing grids is present. Thus, for example, the 45 degree component of an impinging horizontal or vertical field is rotated by the grids to the vertical polarization of the dipole or bicone inside of the grids.

Figure 1A:
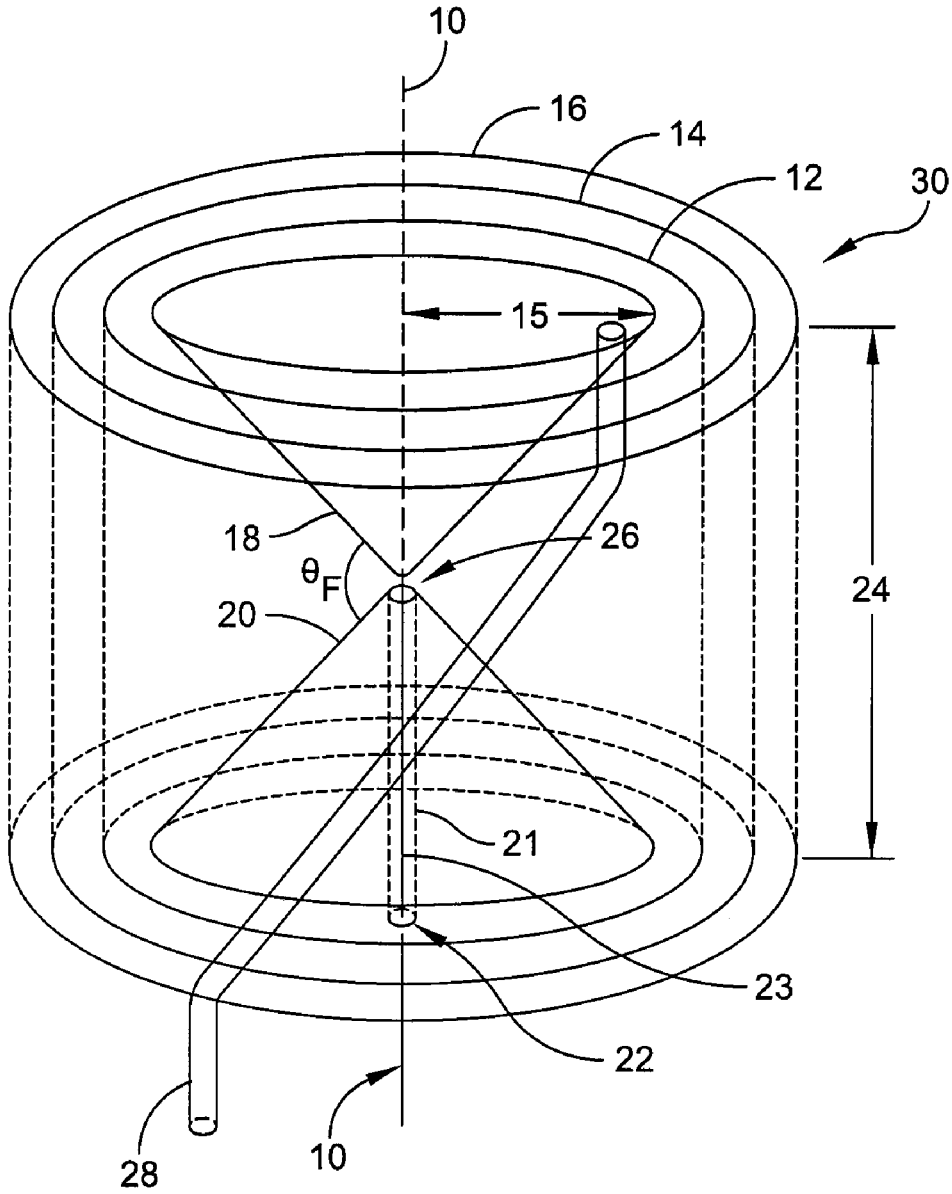
FIG. 1A (PRIOR ART)
FIG. 1A is a prior art drawing of an external grid bicone antenna configuration having 15, 30 and 45 degree grid layers.
Figure 1B:
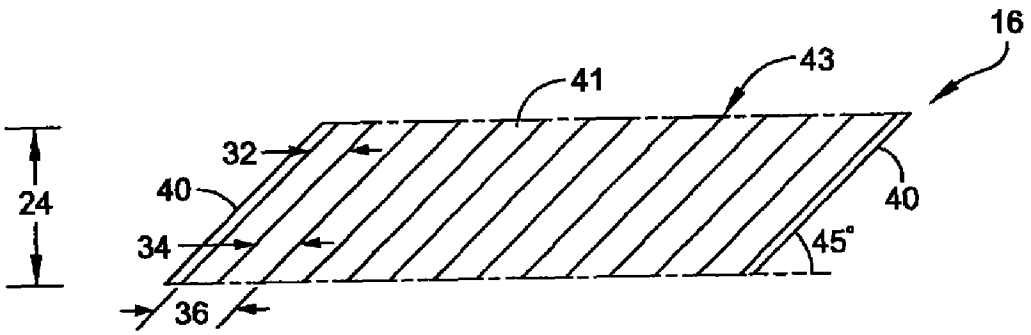
FIG. 1B (PRIOR ART)
FIG. 1B is a diagram of the unraveled 45 degree grid layer of FIG. 1A.
Figure 1C:
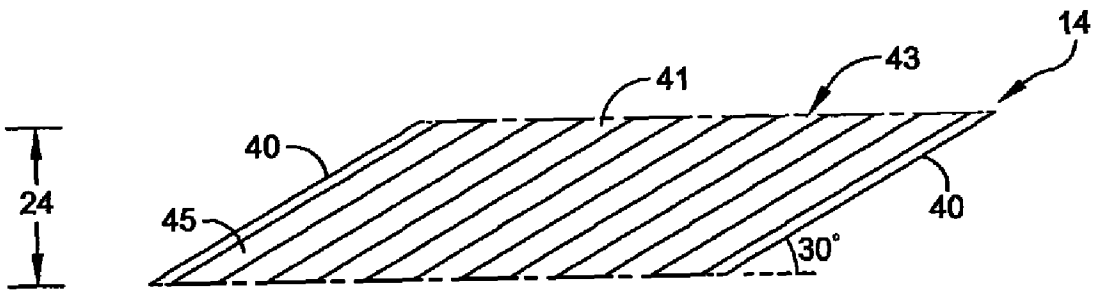
FIG. 1C (PRIOR ART)
FIG. 1C is a diagram of the unraveled 30 degree grid layer of FIG. 1A.
Figure 1D:
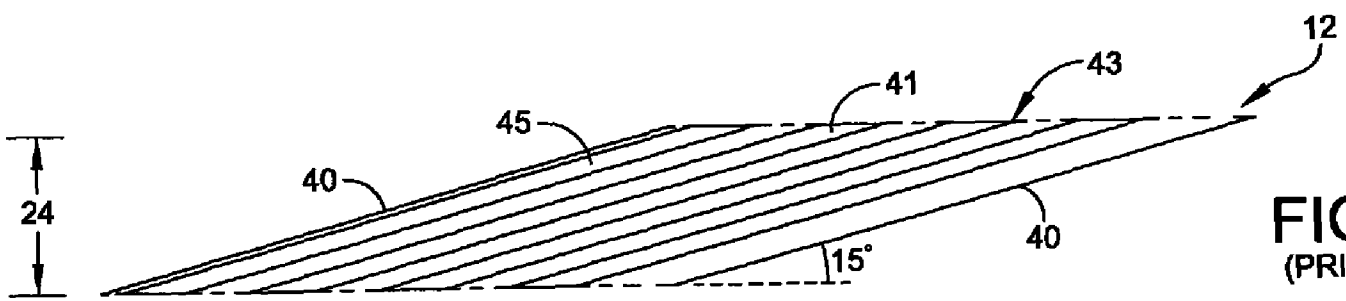
FIG. 1D (PRIOR ART)
FIG. 1D is a diagram of the unraveled 15 degree grid layer of FIG. 1A.
Figure 2:
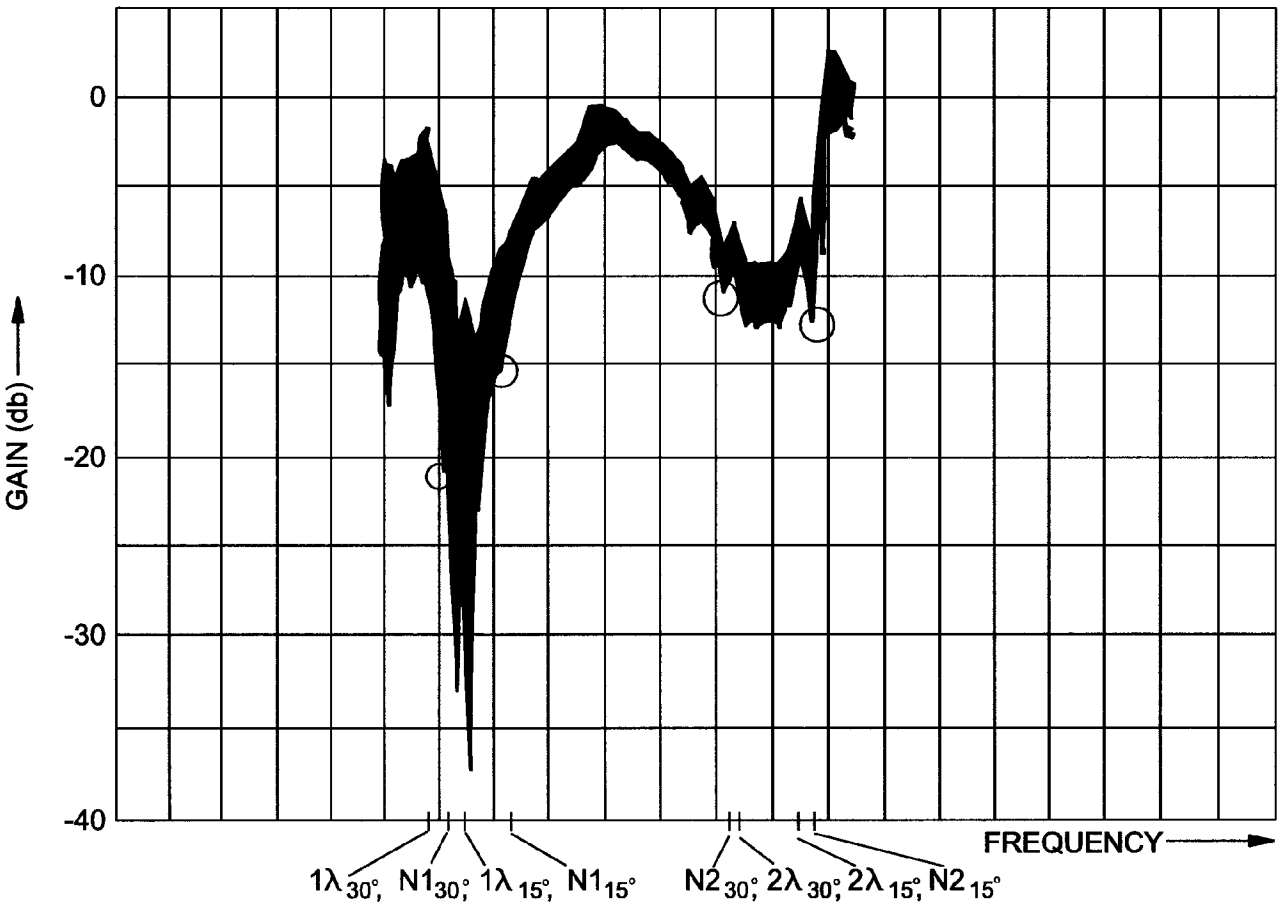
FIG. 2 (PRIOR ART)
FIG. 2 is a graph of vertical polarization gain versus frequency for all azimuths of the bicone antenna of FIG. 1 without the 45 degree grids.
Figure 3:
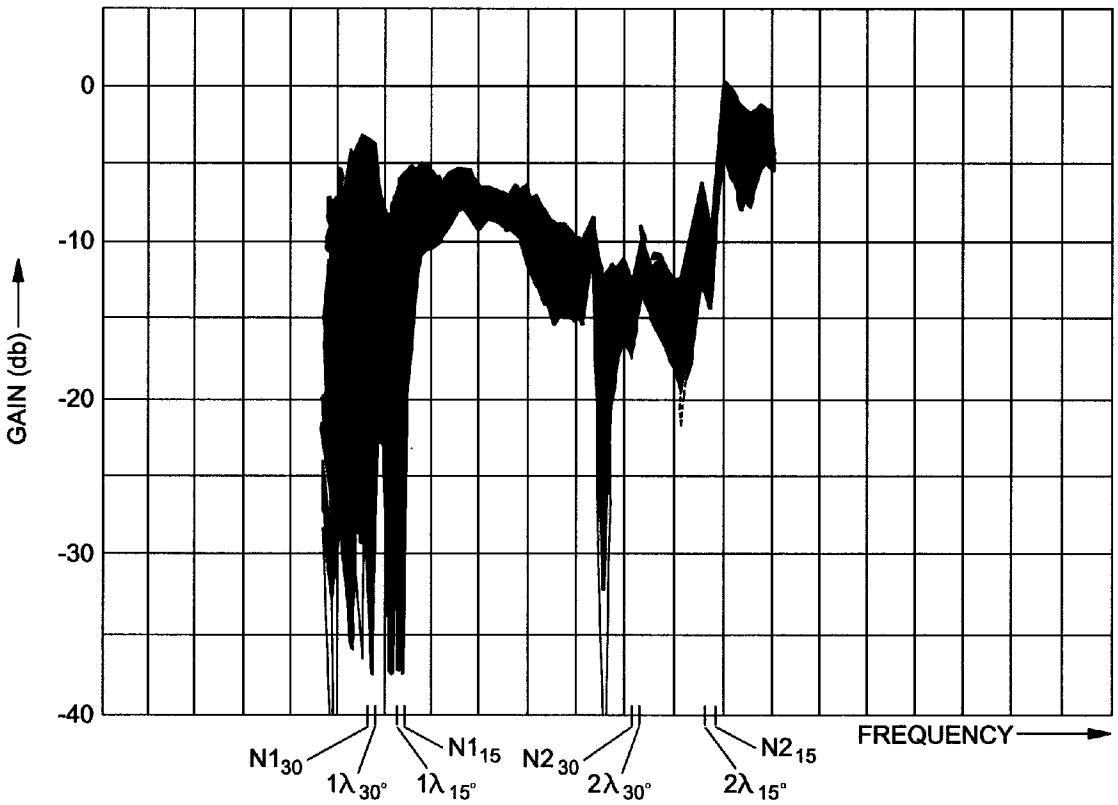
FIG. 3 (PRIOR ART)
FIG. 3 is a graph of horizontal polarization gain versus frequency for all azimuths of the bicone antenna of FIG. 1 without the 45 degree grids.
Figure 4:
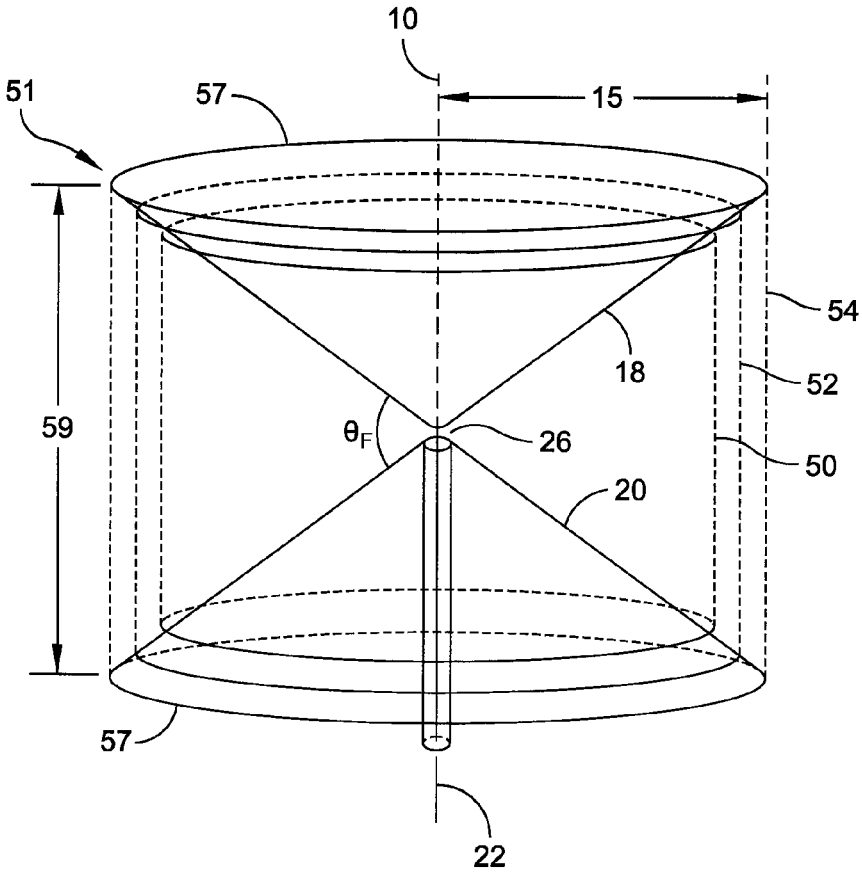
FIG. 4 (PRIOR ART)
FIG. 4 is a prior art drawing of an internal grid bicone antenna configuration having 15, 30 and 45 degree grid layers.
Figure 5:
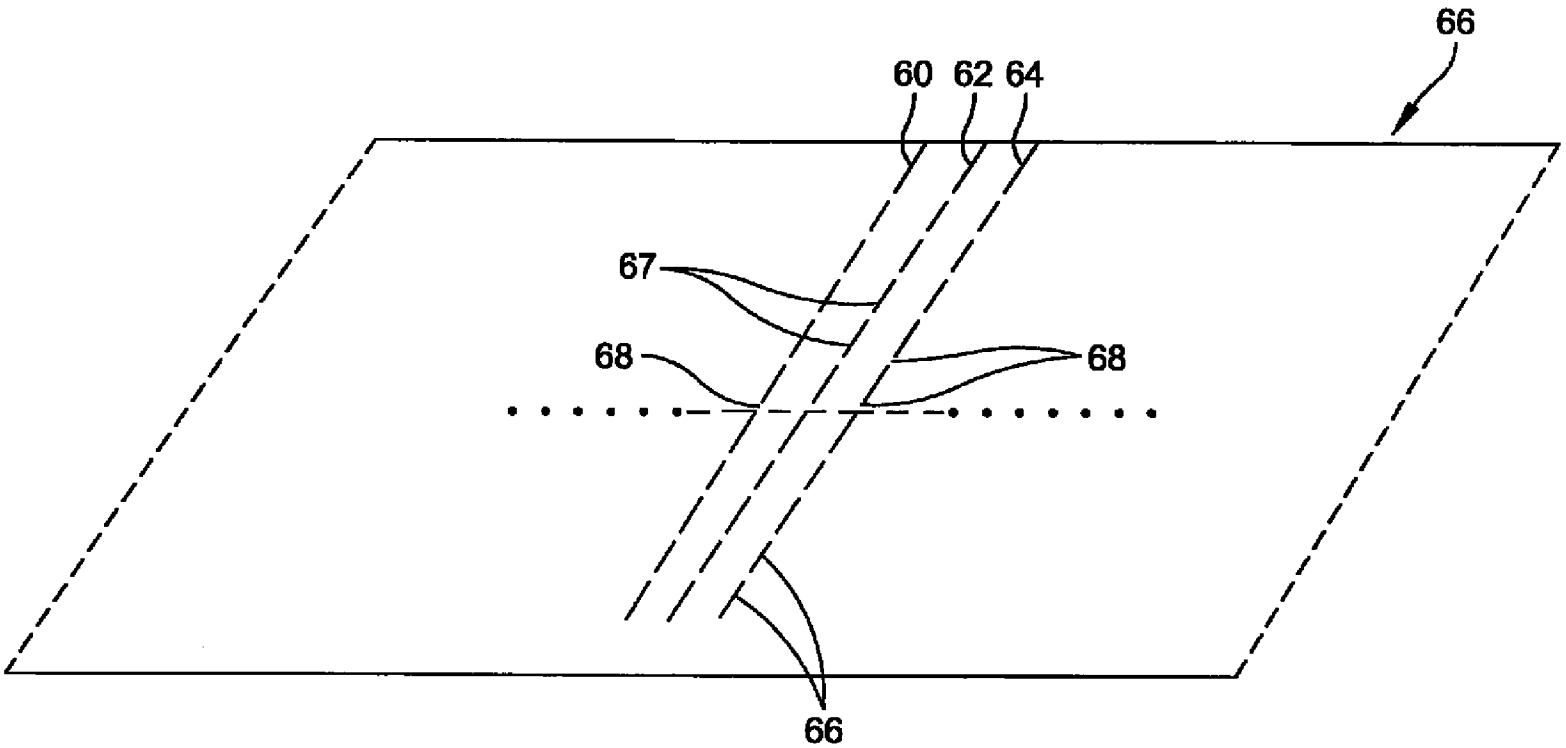
FIG. 5 is a diagram of part of a grid layer having grid lines broken into separated segments.

Grids can be made to disappear electrically (i.e., to not appreciably effect a passing electrical field) by physically breaking each of the grids in a layer of grids into many pieces or segments, as shown in FIG. 5, so that each segment of the grid is electrically small having high impedance. FIG. 5 shows three of the grids 60, 62, 64 in a layer 66 of grids. Each grid 60, 62, 64 is broken into segments 67 having gaps 68 where no metallic grid is present.

A general rule is that the length of each grid segment 67 should be of maximum size of ⅛ wavelength. This is derived from the impedance of a monopole. At ¼ wavelength length a monopole is at low impedance. At ⅛ wavelength length a monopole is approaching a high capacitive impedance with decreased length and decreased frequency, and is thus starting to look electrically small, at which point the monopole starts not effecting any field impinging on the monopole.

Figure 6:
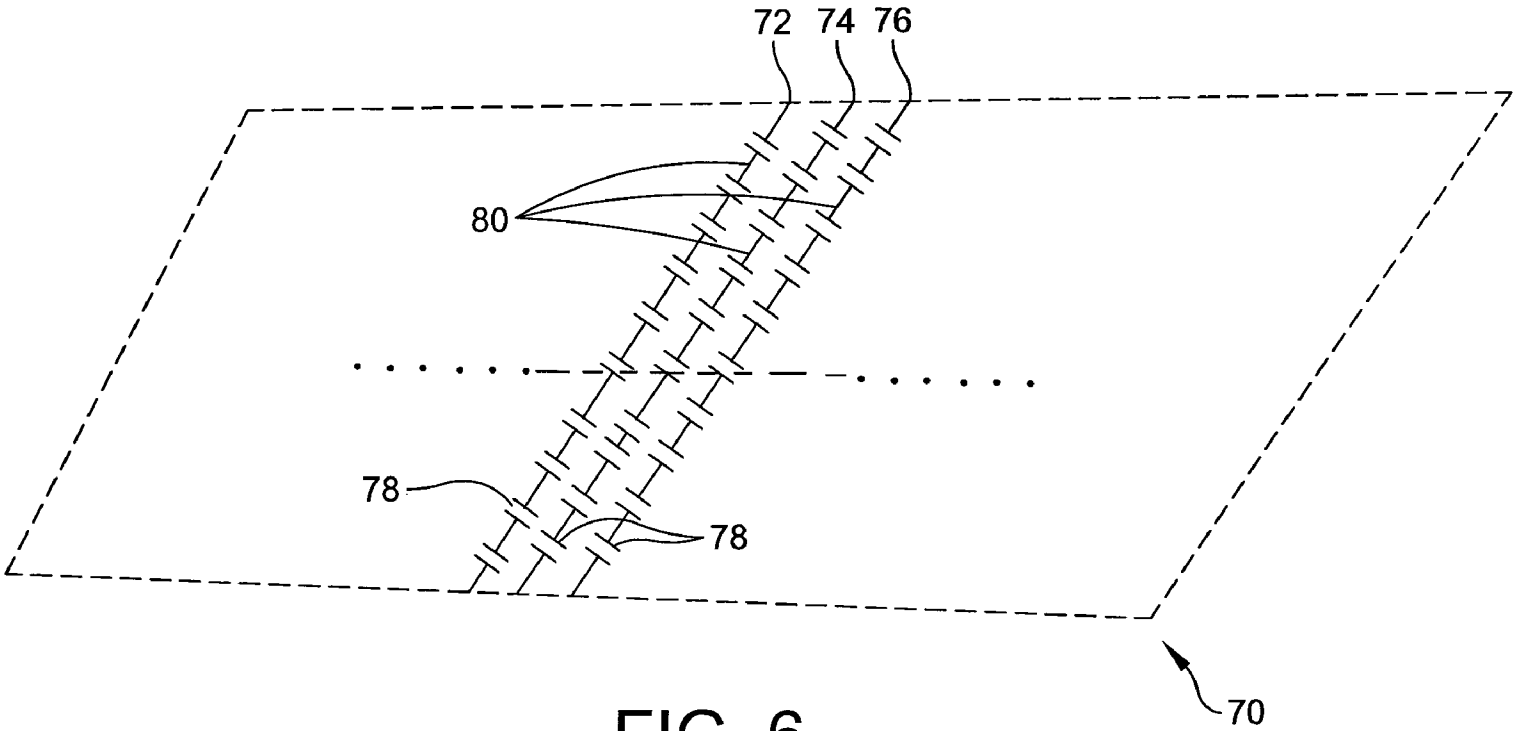
FIG. 6 is a diagram of the partial grid layer of FIG. 5 with capacitors bridging the gaps at the broken points on the grid lines.

The transition between the appearance of broken up, disappeared grids to the case of normal, continuous grids can be implemented by placing suitably valued capacitors along the length of the grids at the points where breaks are to occur. FIG. 6 is a similar configuration to FIG. 5 with capacitors 78 (FIG. 6) replacing the gaps 68 (FIG. 5). FIG. 6 shows three of the grids 72, 74, 76 in a layer 70 of grids. Each grid 72, 74, 76 is broken into segments 80 separated by capacitors 78.

At low frequencies, capacitors have high impedance and are thus effectively breaking up the grids into individual segments. At higher frequencies, the impedance of the capacitors becomes low allowing the grids to appear electrically continuous.

A possible problem with the use of capacitors is that the series capacitive impedance added to the grid lengths will make the grids look shorter in length, effecting their RF (radio frequency) operation. Normally grids need to be long enough (at least about ½ wavelength) to be reflectors, and thus the height of the cylindrical layers of grids has a minimum value.

Figure 7A:
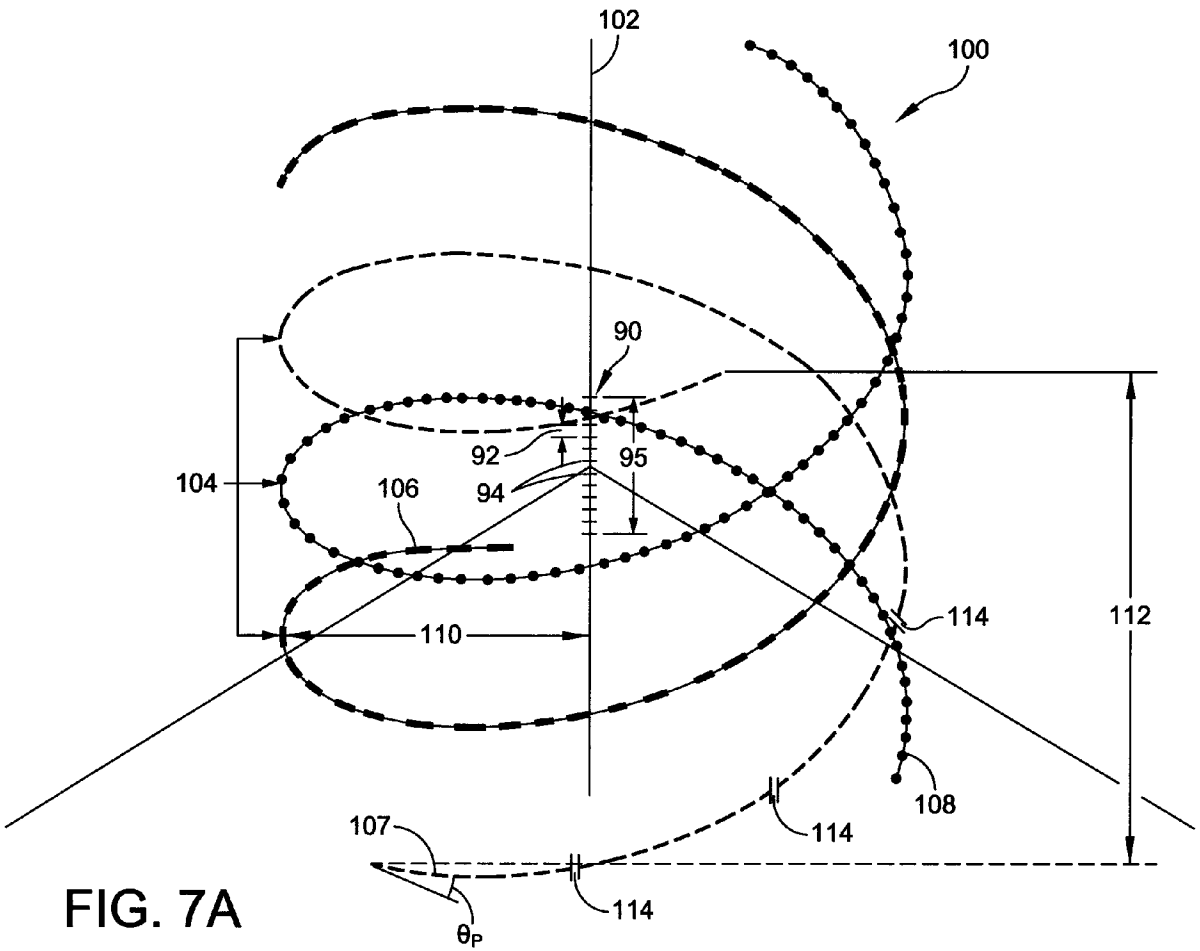
FIG. 7A is a three-dimensional diagrammatic representation of part of a 15 degree grid layer with grids broken into segments bridged by capacitors surrounding a vertical dipole, where only the first few capacitors are shown.

The concept of capacitively loaded grids was investigated with NEC by placing a vertical dipole in the center of a layer of cylindrical grids, as shown in FIG. 7A. To minimize the amount of computational time, the number of layers of grids and the number of grids in a layer were minimized while still maintaining the effect of circumferential resonances.

Referring to FIG. 7A, a dipole 90 is composed of eleven segments, such as segment 92, with each segment having end points indicated by tick marks. The center segment 94 of the dipole 90 is the feed point of the whole antenna configuration 100. The length 95 of the dipole 90 is chosen so that it is ½ wavelength at 1 GHz. The dipole 90 is used to probe the fields inside the antenna configuration 100, primarily to determine the behavior of the grids.

One layer of cylindrical polarizing grids 104 is centered about the axis 102 of the dipole 90. The grid layer 104 is composed of a minimum of three grids 106, 107, 108. Each grid 106, 107, 108 of the grid layer 104 in this example has a pitch angle $\theta_P$ of 15 degrees with the horizon and was chosen to represent the innermost layer of grids of a typical antenna grid configuration as previously discussed with respect to FIG. 1. In practice, multiple grid layers would be used in a gridded antenna configuration with the grids having various pitch angles $\theta_P$.

The radius 110 of the grid layer 104 is chosen to be 1 wavelength at 1 GHz so that the behavior of the grids as a function of size in wavelengths can be directly determined from the frequency. The height 112 of the grid layer 104 is 2 wavelengths at 1 GHz, a size more than adequate to surround the space around the dipole 90.

A grid in this example is made up of sixty segments, with nine capacitors 114 inserted into and distributed evenly along the length of each grid. For exemplary purposes only three capacitors are shown in FIG. 7A in grid 107, although in practice capacitors are used to bridge grid segments in all grids in every grid layer.

Figures 7B, 7C:
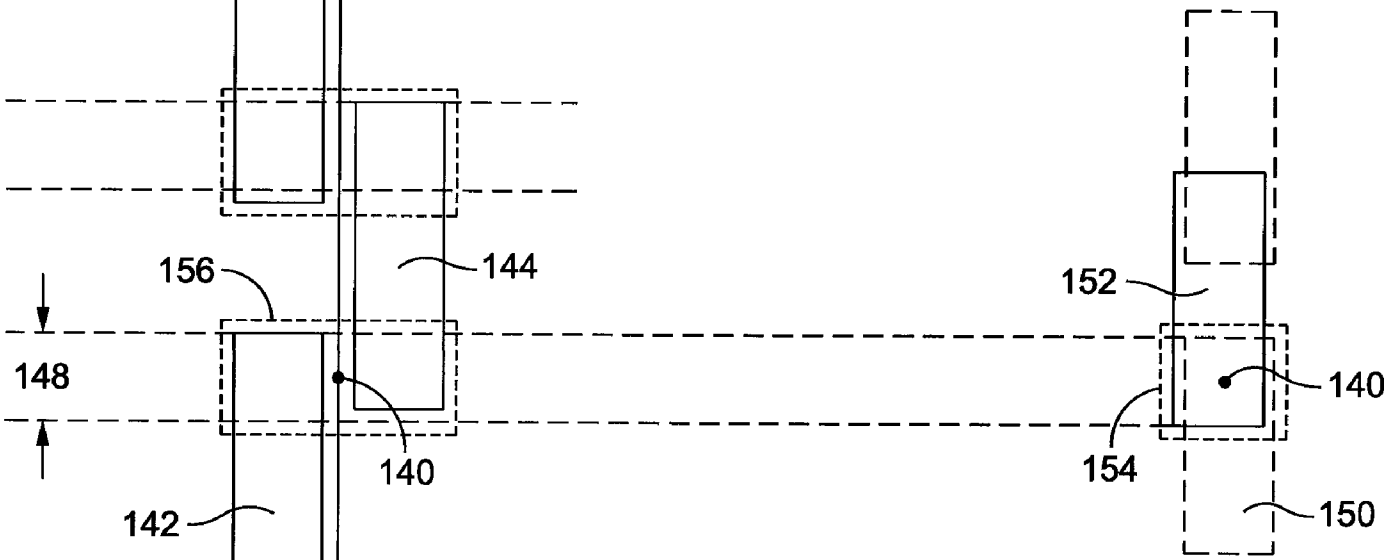
FIGS. 7B and 7C are diagrams illustrating the formation of capacitors between adjacent grid segments.

The capacitors can be made by extending the ends of the segments beyond the gap so that the ends of the two segments on opposite sides of a gap overlap to form a capacitor. There are two ways to do this as shown in FIGS. 7B and 7C.

Reference numeral 140 shows the original location of the gap. Adjacent segments, such as segments 142 and 144, are placed on opposite sides of a common axial line 146, so that the overlapping areas 148 of both segments forms coplanar capacitor 156. This would be used for smaller values of capacitance.

Adjacent segments, such as segments 150 and 152, are placed on opposite sides of the dielectric sheet to which they are mounted, so that the overlapping areas 148 of both segments are separated by the sheet, and form a planar capacitor 154. This would be used for larger capacitance values.

For a given antenna configuration, the values of the capacitors are the same. Over a range of tested antenna configurations, the values of the capacitors were varied from 20000 to 0.2 picofarads (pF) by a multiplier of 10. Of course, other capacitive values outside of this range can also be used. The following capacitors of TABLE 3 were used during testing. The configuration they were in is identified both in the table and in the drawings by similar reference numerals (e.g., ref #120).

TABLE 3

| CONFIGURATION AND TRACE REFERENCE NUMBER | CAPACITANCE IN PICOFARADS | IMPEDANCE IN OHMS AT 1 GHZ |
|---|---|---|
| 120 | 20000 | 0.007958 |
| 122 | 2000 | 0.07958 |
| 124 | 200 | 0.7958 |
| 126 | 20 | 7.958 |
| 128 | 2 | 79.58 |
| 130 | 0.2 | 795.8 |

Figure 8:
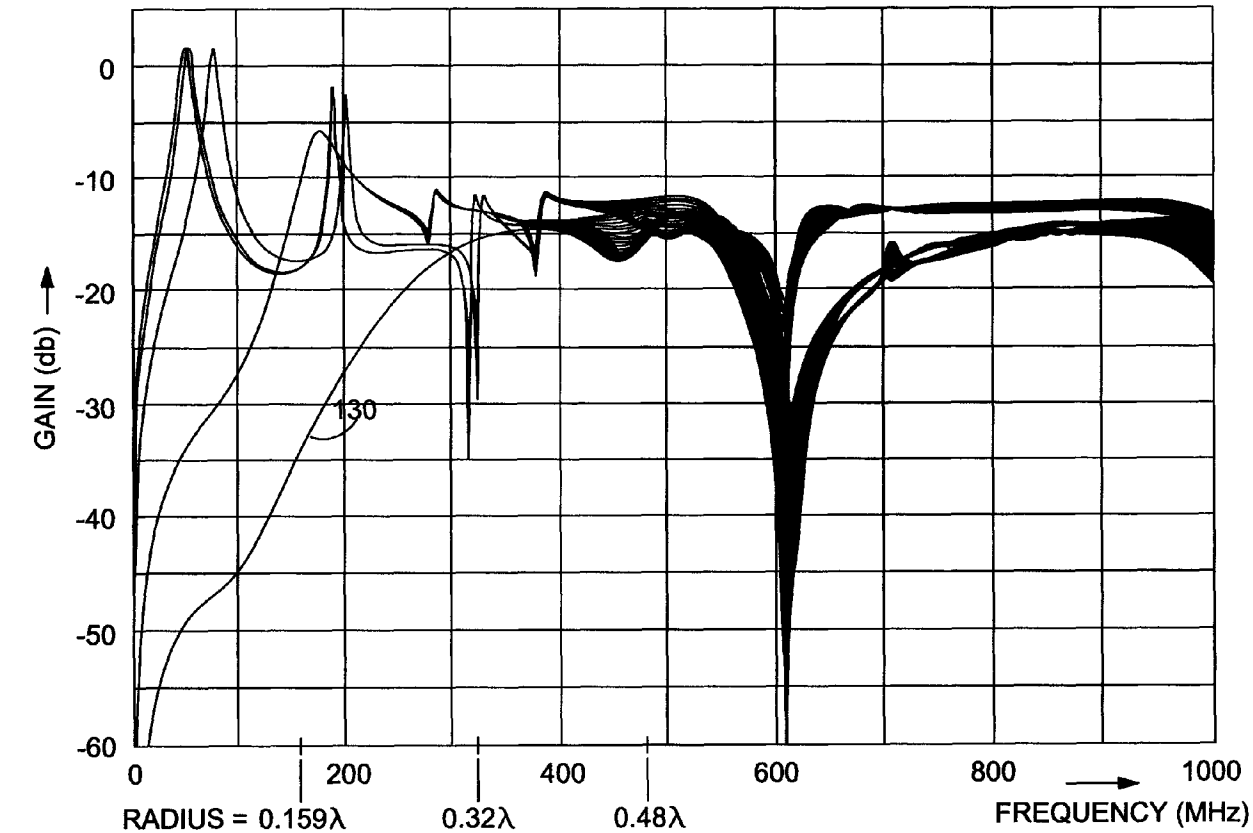
FIG. 8 is a graph of true horizontal response curves of gain (decibels) versus frequency (Megahertz) of the dipole of FIG. 7.

Results of the above testing are summarized where: (1) FIG. 8 is a graph of true horizontal response curves (without offsets) of gain (db) versus frequency (MHz) of the dipole of FIG. 7A; (2) FIG. 9 is a graph of offset horizontal response curves of gain (db) versus frequency (MHz) of the dipole of FIG. 7A; and FIG. 10 is a graph of offset vertical response curves of gain (db) versus frequency (MHz) of the dipole of FIG. 7A.

Figure 9:
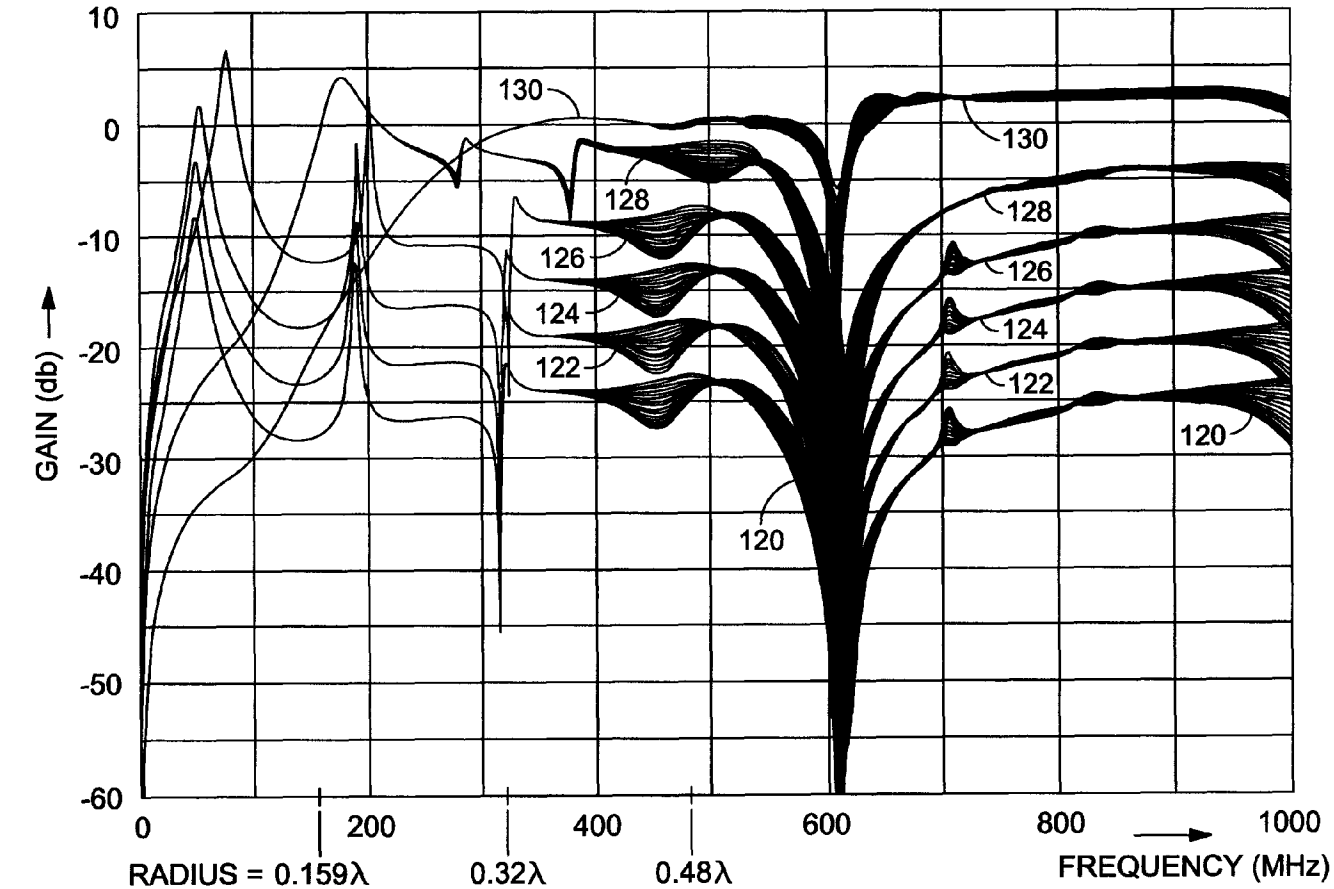
FIG. 9 is a graph of offset horizontal response curves of gain (db) versus frequency (MHz) of the dipole of FIG. 7.

FIG. 9 illustrates the horizontal dipole response with grids broken into segments separated by the capacitors of TABLE 3 with traces offset 5 db (decibels) to differentiate the traces and make the results easier to see than in the true response curve of FIG. 8. FIG. 10 illustrates the vertical dipole response with grids broken into segments separated by the capacitors of TABLE 3, also with 5 db trace offsets.

Figure 10:
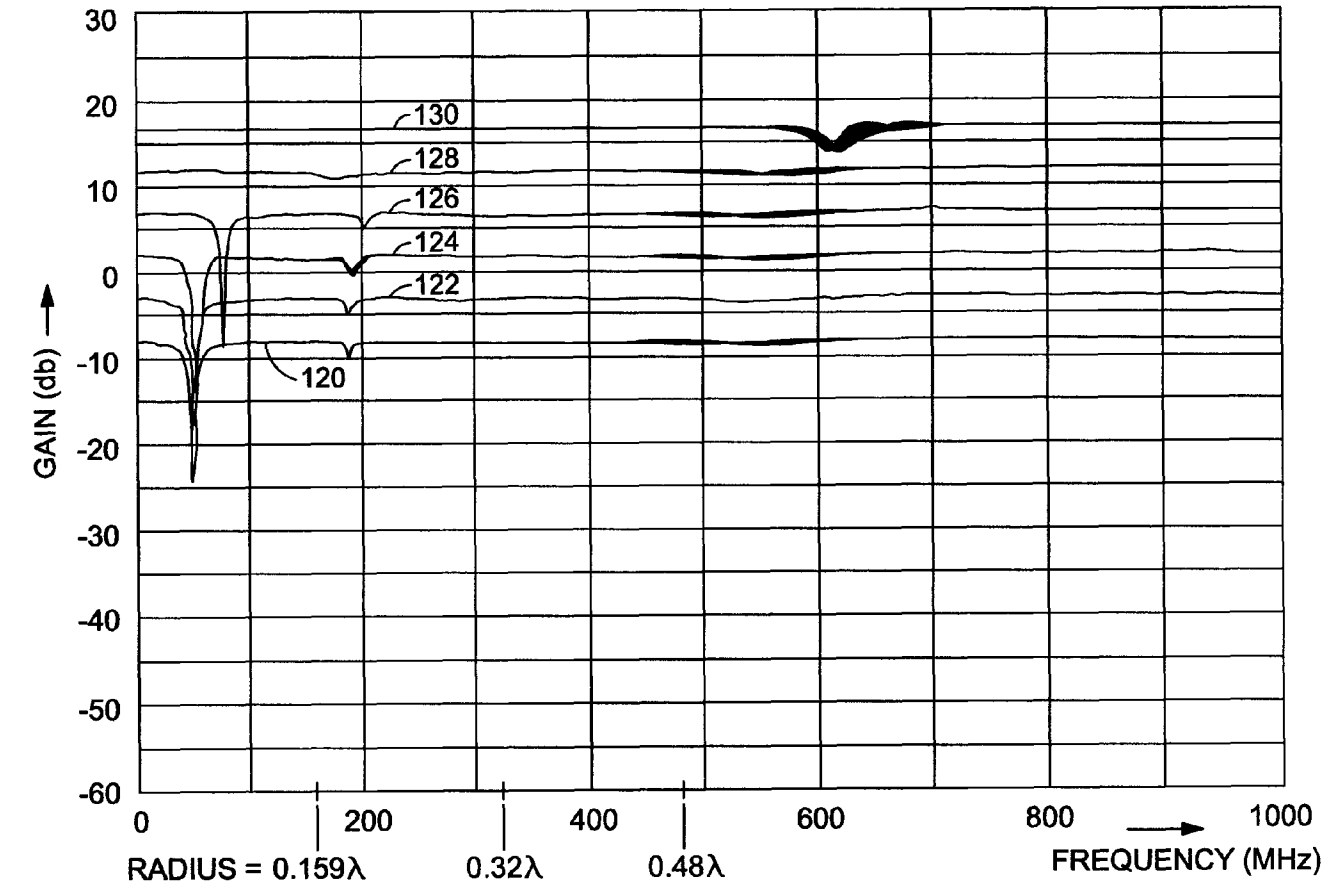
FIG. 10 is a graph of offset vertical response curves of gain (db) versus frequency (MHz) of the dipole of FIG. 7.

FIGS. 8-10 show the azimuthal responses at all azimuths for horizontal and vertical polarization. Since the radius is 1 wavelength at 1 GHz, the circumference in each graph is 1 wavelength when the radius is 0.16 wavelength (160 MHz) and 2 wavelengths when the radius is 0.32 wavelength (320 MHz). At or near these frequencies, nulls are seen due the circumferential resonances for the cases where these is essentially no capacitive loading for both polarizations in curve 120 in FIGS. 8 to 10, except for an essentially disappeared null in the 2 wavelength and vertical polarization case, and for a gain spike at one wavelength for horizontal polarization. Measurements have shown, however, that this spike should be a gain null also.

As the capacitive loading increases from TRACE 120 to TRACE 130 (see TABLE 3 and FIGS. 8-10), the two gain nulls shift to higher frequencies and reduce in magnitude, until the two resonances are gone with the maximum capacitive loading of the curve 130 as shown in FIGS. 9 and 10.

Also a cut-in frequency exists for the horizontal response and it shifts to higher frequencies with increased loading. All shifting to higher frequencies is an expected and an intended result of loading and opening up the grids by the high capacitor impedances at lower frequencies. The capacitors are effectively shortening the circumference of the grids. The cut-in frequency is present because at zero frequency, the grids of zero size are invisible and thus no rotation of horizontal polarization to the vertical polarization of the antenna for reception is possible. When the cut-in frequency is approximately near or past the frequency where the circumference is 2 wavelengths, the gain nulls of 1 and 2 wavelength circumferences disappear and the horizontal polarization response equates to the response of a high pass filter below and near cut-in.

According to the above configuration, the 1 and 2 wavelength circumferential resonances of the grids, and their associated gain nulls, are gone. This requires at least some loss of the horizontal response at the resonance frequencies. Below cut-in near the second resonance, horizontal response cuts out like a high pass filter and thus antenna response is vertical. Above cut-in, there is little change in horizontal response (ignoring other effects such as the null at 610 MHz) and thus antenna response is approximately minus 15 db horizontal and approximately +2 db vertical.

The horizontal gain at all frequencies is appreciably less than the vertical gain due to the use of only a layer of 15 degree grids which rotate an incident wave only a small amount in the horizontal direction. There is significant shunting in the horizontal direction by the 15 degree grid layer.

The gain null at 610 MHz is the first ½ wavelength reflection null discussed earlier herein. For the horizontal polarization, significant reduction of this null can be seen with the maximum capacitive loading of curve 130, and thus capacitive loading also helps reduce nulls formed from reflections off of the innermost grid layer. This is due again to the capacitors making the grids disappear to some degree even at frequencies above cut-in. The gain nulls in the vertical plots are small since the 15 degree grid layer does little shunting in the vertical direction.

The antenna allows removal of grid circumferential resonances by opening up the grids at the resonance frequencies. The tradeoff is reduced horizontal response in the area of these frequencies. The antenna also allows reduction of nulls formed by reflection off of the innermost grid layer.

The above preferred embodiment is an example using only one 15 degree grid layer for demonstrative purposes. In practice, all grid layers in an antenna grid configuration such as shown in FIG. 1, for example, which has equal horizontal and vertical polarization response, would require capacitive loading, since a normal configuration has multiple layers of grids.

The same principles and procedures of the example above, directed to a dipole antenna, are applicable to a bicone antenna or other vertically polarized antenna in external or internal grid configurations.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive or to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A forty five degree polarized antenna comprising:

a bicone having a top conductive cone and a bottom conductive cone each of which have an identical conical radius $R_B$ and identical physical dimensions, wherein said top conductive cone and said bottom conductive cone are disposed in an oppositely directed stacked configuration along a vertical antenna axis, wherein the combined lengths of said top conductive cone and said bottom conductive cone equal a bicone height; and at least one grid layer wrapped around the bicone, each said at least one grid layer comprising a plurality of grids, wherein each said plurality of grids further comprises a plurality of segments separated by plurality of capacitors.

2. The forty five degree polarized antenna of claim 1, wherein each of said at least one grid layer has a grid height at least equal to the bicone height, and each said at least one grid layer is wrapped around the top conductive cone and bottom conductive cone outside of the bicone radius $R_B$.

3. The forty five degree polarized antenna of claim 2, wherein each said at least one layer is wrapped one circumferential length around the top conductive cone and bottom conductive cone in a cylindrical configuration.

4. The forty five degree polarized antenna of claim 1, wherein each said at least one layer is wrapped around the top conductive cone and bottom conductive cone within the bicone radius.

5. The forty five degree polarized antenna of claim 4, wherein each said at least one layer is wrapped one circumferential length around the top and bottom cones.

6. The forty five degree polarized antenna of claim 1, wherein said at least one grid layer further comprises a fifteen degree grid layer, a thirty degree grid layer, and a forty five degree grid layer.

7. The forty five degree polarized antenna of claim 1, wherein values of said plurality of capacitors ranges from 0.2 to 20000 picofarads.

8. A forty five degree polarized antenna comprising:

a dipole having a dipole height; and at least one grid layer, each said at least one grid layer having a grid height at least equal to the dipole height, wherein each said at least one grid layer is wrapped around the dipole, each said at least one grid layer comprises a plurality of grids, wherein each of said plurality of grids further comprises a plurality of segments separated by a plurality of capacitors.

9. The forty five degree polarized antenna of claim 8, wherein each said at least one grid layer is wrapped one circumferential length around the dipole in a cylindrical configuration.

10. The forty five degree polarized antenna of claim 8, wherein said at least one grid layer further comprises a fifteen degree grid layer, a thirty degree grid layer, and a forty five degree grid layer.

11. The forty five degree polarized antenna of claim 8, wherein values of said plurality of capacitors ranges from 0.2 to 20000 picofarads.

12. A method of eliminating or reducing grid circumferential resonances and their nulling effects and partially reducing nulling effects from reflections off of the innermost grid layer in a forty five degree polarized antenna having an antenna axis and an antenna height, the method comprising the steps of:

providing at least one grid layer, each said at least one grid layer comprising a plurality of grids, wherein each of said plurality of grids further comprises a plurality of segments separated by a plurality of capacitors; and wrapping said at least one grid layer around a vertically polarized antenna centered on the antenna axis.

13. The method of claim 12, wherein the vertically polarized antenna is a bicone antenna having two cones of equal bicone radius.

14. The method of claim 13, wherein each said at least one grid layer has a grid height equal to or larger than a bicone height, and each said at least one grid layer is wrapped around the two cones outside of the bicone radius in a cylindrical configuration.

15. The method of claim 14, wherein each said at least one grid layer is wrapped one circumferential length around the two cones in a cylindrical configuration.

16. The method of claim 13, wherein each said at least one grid layer is wrapped around the two cones within the bicone radius.

17. The method of claim 16, wherein each said at least one grid layer is wrapped one circumferential length around the two cones.

18. The method of claim 12, wherein said at least one grid layer further comprises a fifteen degree grid layer, a thirty degree grid layer, and a forty five degree grid layer.

19. The method of claim 12, wherein values of said plurality of capacitors ranges from 0.2 to 20000 picofarads.

* * * * *